United States Patent [19]

Iwata

[11] Patent Number: 4,492,538

[45] Date of Patent: Jan. 8, 1985

[54] SQUEEZE PUMP

[75] Inventor: Noboru Iwata, Gifu, Japan

[73] Assignee: Daiichi Engineering Co., Ltd., Gifu, Japan

[21] Appl. No.: 440,214

[22] PCT Filed: Dec. 3, 1981

[86] PCT No.: PCT/JP81/00364

§ 371 Date: Aug. 2, 1982

§ 102(e) Date: Aug. 2, 1982

[87] PCT Pub. No.: WO82/02075

PCT Pub. Date: Jun. 24, 1982

[30] Foreign Application Priority Data

| | | | |
|---|---|---|---|
| Dec. 13, 1980 | [JP] | Japan | 55/176235 |
| Mar. 25, 1981 | [JP] | Japan | 56/44490 |
| Jul. 6, 1981 | [JP] | Japan | 56/105354 |
| Jul. 23, 1981 | [JP] | Japan | 56/116270 |

[51] Int. Cl.[3] ..... F04B 43/12; F04B 45/08

[52] U.S. Cl. ..... 417/477

[58] Field of Search ..... 417/477, 476

[56] References Cited

U.S. PATENT DOCUMENTS

| | | | |
|---|---|---|---|
| 2,831,437 | 4/1958 | Cromwell et al. | 417/477 |
| 3,140,666 | 7/1964 | Currie | 417/477 |
| 3,421,447 | 1/1969 | Jackson et al. | 417/477 |
| 3,790,313 | 2/1974 | Magerle | 417/477 |
| 4,164,223 | 8/1979 | Munib | 417/476 X |

FOREIGN PATENT DOCUMENTS

| | | | |
|---|---|---|---|
| 2040034 | 2/1972 | Fed. Rep. of Germany | 417/477 |

*Primary Examiner*—Richard E. Gluck

*Attorney, Agent, or Firm*—Jordan and Hamburg

[57] ABSTRACT

There is disclosed a squeeze pump in which a resilient tube (15) disposed arcuately in a pump casing (11) is pressed by presser rolls (25) rotatable about their own axes and about a common axis simultaneously, thereby to continuously feed the slurry contained in the tube (15). A plurality of the presser rolls (25) are provided, with the presser rolls (25) of each pair clamping the tube (15) from both sides and respective support shafts (24) for said presser rolls (25) being secured to a rotary arbor (22) serving as said common axis, said arbor (22) extending perpendicular to said shafts (24) and disposed at the center of the pump casing (11).

3 Claims, 17 Drawing Figures

SQUEEZE PUMP

TECHNICAL FIELD

This invention relates to a squeeze pump in which a resilient tube disposed arcuately in a pump casing is pressed by presser rolls rotatable about their own axes and about a common axis simultaneously, thereby to continuously feed the slurry contained in the tube.

BACKGROUND ART

The squeeze pump so far known in the art is shown in FIG. 1 and comprises a resilient tube 2 bent arcuately and placed along the inner periphery of the pump casing 1, and a plurality of presser rolls 5 carried by end parts of rotary arms 4 parallel to a rotary arbor 3 integral with said rotary arm 4. Upon rotation of the rotary arm 4 in the direction of the arrow mark in FIG. 1, the respective presser rolls 5 on the resilient tube 2 whilst the tube 2 is clamped between the rolls 5 and the inner periphery of the pump casing 1, for transferring the slurry in the tube 2.

However, in this known type of the squeeze pump, since the resilient tube 2 is pressed by the presser rolls 5 onto the inner peripheral surface of the pump casing 1, such peripheral surface must be accurately arcuate for stably clamping said resilient tube 2 between the presser rolls 5 and the inner peripheral surface of the pump casing 1. Moreover, to prevent the damage of the resilient tube 2, such peripheral surface must be ground to a smooth surface, while the rotary shaft 3 must be centered accurately in the pump casing 1 so that said presser rolls 5 may accurately follow the inner peripheral surface of the pump casing 1.

On the other hand, when the resilient tube 2 is mounted in the casing 1 in an arcuate form along the arcuate surface, the tube 2 may be elliptical in cross-section and moreover the tube 2 is pressed by the rolls 5 is a direction to further flatten out the ellipsis. As a result, the tube 2 may be restored simply to an elliptical cross-section after passage through the presser rolls 5. Thus the tube 2 may be deformed permanently to an elliptical cross-section with prolonged use resulting in the reduction of the slurry quantity to be transferred. In addition thereto, since the tube 2 is pressed onto the inner peripheral surface of the pump casing 1, the tube 2 tends to be elongated slightly and heated due to strong friction caused by pressure contact between the tube 2 and the peripheral surface, thus causing premature wear of the tube 2.

This invention has been made to overcome these deficiencies and has it as an object to provide a squeeze pump wherein the slurry may be transferred effectively, the resilient tube may be improved in durability by preventing the wear caused to the tube, and manufacture may be facilitated.

It is another object of the present invention to provide a squeeze pump wherein the tube may have improved restorability after pressing with resultingly improved efficiency of slurry suction by the resilient tube.

It is another object of the present invention to provide a squeeze pump wherein the inner peripheral surface of the pump casing need not have a ground finish and the rotary arbor may be centered roughly, resulting in the reduced manufacture costs of the overall device.

It is another object of the present invention to provide a squeeze pump wherein a rib is mounted at the center of the inner peripheral surface of the pump casing for setting the radius of bend of the resilient tube, whereby the mounting of the tube within the pump casing may be facilitated.

It is another object of the present invention to provide a squeeze pump wherein tube fatigue to be caused at the start and termination of clamping of the resilient tube may be reduced.

It is another object of the present invention to provide a squeeze pump wherein the hard materials contained in the slurry may not encroach on the inner surface of the tube during pressing of the tube by the presser rolls to prevent the wear of the tube.

It is yet another object of the present invention to provide a squeeze pump wherein the presser rolls may positively press the tube without slipping.

DISCLOSURE OF INVENTION

According to the present invention, a resilient tube 15 is pressed by presser rolls 25 not from the inner side, but from transverse sides, so that the tube 15, disposed in a pump casing 11 and collapsed spontaneously into an elliptical cross-sectional shape, may be restored to the original circular cross-sectional shape through contact with the presser rolls 25. In such manner, the resilient tube 15 may be prevented from being deformed permanently into an elliptical cross-section to assure a sufficient quantity of the slurry to be transferred.

According to the present invention, since the resilient tube 15 is not pressed between the presser rolls 25 and the pump casing 11, the tube 15 does not tend to be stretched or elongated from the center towards the inner periphery of the pump casing 11, resulting in the increased durability of the tube 15. Moreover, since the pump casing 11 is not required to support the tube 15, the pump casing 11 may theoretically be omitted and simply be used as a cover or hood.

In addition, since a resilient member 27 is mounted on the foremost part of each presser roll 25, it is possible to make use of the resiliency of the resilient member 27 at the start and termination of pressing of the resilient tube 15 by the presser rolls 25, that is, at the time that the foremost parts of the presser rolls 25 start to nip both sides of the tube 15 and release the tube 15, to soften the impinging of the presser rolls 25 on the sides of the tube 15 and to lessen the fatigue caused to the tube 15.

In addition, since the tube 15 is provided with peripheral grooves 18, the tube 15 may have improved flexibility with each presser roll 25. In the embodiment shown in FIGS. 6 and 7, when the presser roll 25 acts on the grooved peripheral surface of the tube 15, the grooved surface is bent acutely, so that the nip angle $\alpha$ relative to the inner wall of the tube 15 is increased. Thus the material may not be easily nipped between the tube portion pressed by the presser rolls 25, and the tube 15 may not be worn out promptly and hence may have improved durability. Moreover, in the present embodiment, since the tube 15 is pressed from both transverse sides by a pair of presser rolls 25, the nip angle $\alpha$ may be made larger than in the case the tube 15 is pressed only from one transverse side.

With the nip angle $\alpha$ thus increased, the capacity between the rolls 25 may be increased for effective transfer of the slurry. Moreover, the resilient tube 15 is of an increased thickness and thus may have improved restorability after the release of pressure exerted from the pressing rolls 25.

According to the invention, the tube 15 is provided with peripheral grooves 18 whereby the radius of arcuate bend of the tube 15 in the pump casing 11 may be set to a lower value so that the pump casing 11 may have a reduced diameter.

A rib 14 is also provided to the inner periphery of the pump casing 11 as an aid for setting the radius of bend of the resilient tube 15 and mounting the tube 15 in the pump casing 11.

The presser roll 25 is frusto-conical in cross-section with the diameter increasing towards radially outer end thereof so that the rolls 25 may not slip on the tube 15 when the tube 15 is pressed by the presser rolls 25 and the tube 15 may be pressed reliably by the presser rolls 25.

BEST MODE FOR CARRYING OUT THE INVENTION

Figure 1:
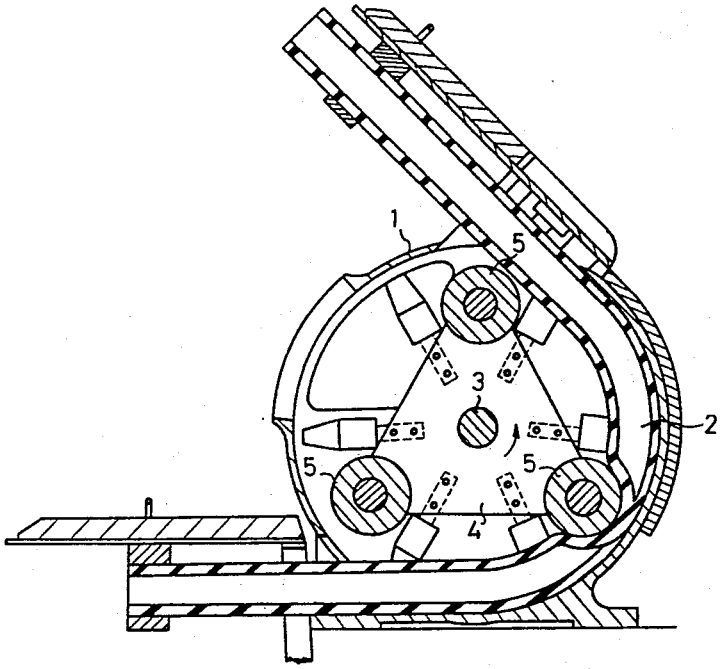
FIG. 1 PRIOR ART
FIG. 1 is a sectional view showing an example of the conventional squeeze pump.
Figure 2:
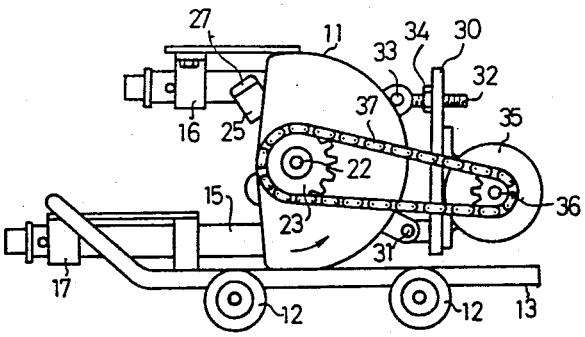
FIG. 2 is a front view showing a squeeze pump embodying the present invention.

Referring to FIGS. 2 to 8 which illustrate a preferred embodiment of the present invention, the numeral 11 denotes a substantially semicylindrical pump casing secured on a base table 13 provided with wheels 12. The numeral 14 denotes an arcuate rib secured in the center of the arcuate inner periphery of the pump casing 11 (FIG. 3) and a resilient tube 15 is arcuately bent and is disposed inwardly of the rib 14. The resilient tube 15 has straight end portions extending forwardly of the pump casing, and one end being carried by a support fixture 16 secured to the upper end of the outer surface of the pump casing 11 and the other end being carried by another support fixture 17 secured on the base table 13.

The numeral 18 denotes a large number of peripheral grooves on the outer surface of the tube 15 which are located in portions other than the straight end sections of the tube 15. These grooves 18 are square-shaped in cross-section with width about 3 to 10 mm and depth about 5 to 8 mm and are provided at intervals of 10 to 25 mm. The numeral 19 denotes a reinforcing cloth layer composed of a plurality of reinforcing cloths 20 embedded in the tube 15 and rubber sheets 21 with thickness of about 1.5 to 4 mm disposed between the reinforcing cloths 20 to prevent these cloths from peeling from one another.

The resilient tube 15 of the present embodiment has an inside diameter of about 100 to 150 mm and a relatively large thickness of about 20 to 38 mm and has the reinforcing cloth layer 19 offset inwardly about one-third the tube thickness from the tube surface.

Figure 3:
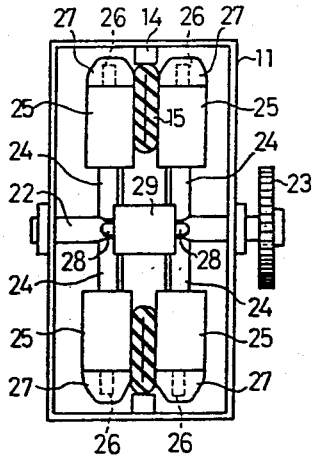
FIG. 3 is a partial enlarged side elevation thereof.
Figure 4:
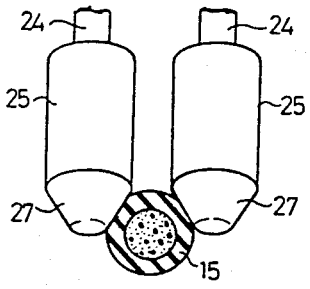
FIGS. 4 and 5 are side elevational views showing the presser rolls starting to press the resilient tube.
Figure 5:
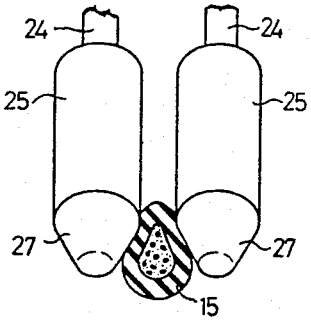
Figure 6:
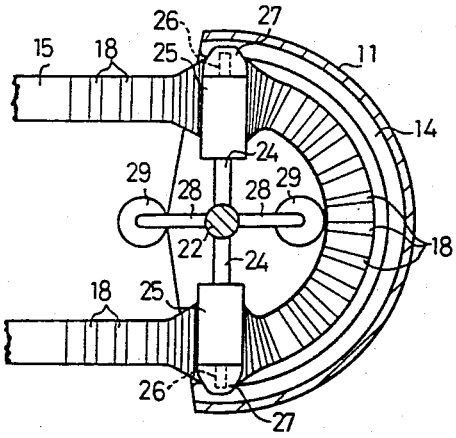
FIG. 6 is a front view showing the tube clamped completely by the presser rolls.
Figure 7:
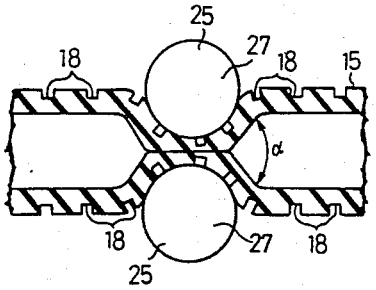
FIG. 7 is a cross-sectional view from above showing the tube being clamped.
Figure 8:
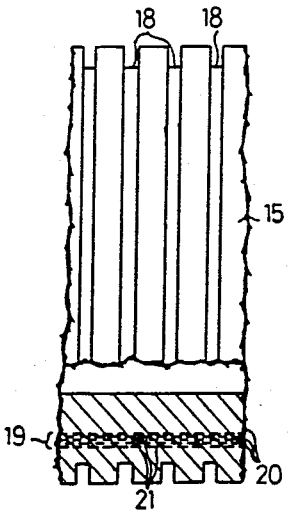
FIG. 8 is a partial enlarged sectional view of the resilient tube.

The numeral 22 denotes a rotary arbor mounted between two side plates of the pump casing 11 as shown in FIGS. 3 and 6, and a sprocket 23 is mounted at one end thereof. The numeral 24 denotes a pair of support shafts mounted on the arbor 22 at right angles therewith which extends in the opposite directions to each other with the arbor 22 as center. The support shafts 24 are separated from each other only slightly.

The numeral 25 denotes metallic presser rolls free-rotationally mounted on the extreme ends of the support shafts 24 about their own axes. These presser rolls 25 may not only rotate about the rotary arbor 22 as center but roll on the outer surface of the tube 15 while clamping the tube 15 from both sides. The presser rolls 25 are columnar in shape and have the same thickness from their base ends to their foremost parts. The numeral 26 denotes a stem projectingly mounted in the center of the foremost part of each presser roller 25. The numeral 27 denotes a resilient member made from e.g. rubber which is fixed to the foremost part of the presser roller 25 for as if molding the stem 26. The member 27 may be rotated together with the presser roller 25.

The resilient member 27 is so positioned that the base end thereof is clear of or only slightly contacting with the outer periphery of the tube 15 when the tube 15 is clamped by the associated presser rolls 25. The base end of each resilient member 27 is tapered and machined smoothly so as to have no projecting portions.

The numeral 28 denotes another pair of support shafts secured to the rotary arbor 22 to be displaced 90° from the support shafts 24, and the numeral 29 denotes a pair of restoration rolls mounted on the support shafts 28 for rolling freely. The function of these restoration rolls 29 is to act from the inner side on the resilient tube 15 which has been flattened by the presser rolls 25 to restore its original cylindrical shape and to prevent said tube 15 from moving towards the center of the pump casing 11.

The numeral 30 denotes a motor mounting plate pivotally mounted at the lower portion thereof to the lower rear surfce of the pump casing 11 by means of a shaft 31 (FIG. 2) for tiltable back and forth movement about said pivot 31. The numeral 32 denotes a bolt pivotally mounted at the base end thereof to the rear upper surface by means of a shaft 33, and having the foremost part thereof passing through the upper part of the motor mounting plate 30. The numeral 34 denotes a nut threadedly attached to the bolt 32 and abutting on the front face of the motor mounting plate 30.

The numeral 35 denotes a motor secured to the rear surface of the motor mounting plate 30. An endless chain 37 is mounted between a sprocket 36 and the sprocket 23 mounted on the rotary arbor 22.

Hence, rearward tilting of the motor 35 about the pivot 31 is restrained by the chain 37 while forward tilting thereof is restrained by the nut 34.

In the squeeze pump, mentioned above, when the arbor 22 is rotated by the motor 35 in the direction of the arrow mark, a preceding pair of the presser rolls 25, that is, the pair of rolls 25 disposed at the lower forward portion of the tube 15 and free from contact with the tube 15 at the start of rotation, now starts to contact with and roll on both transverse sides of the tube 15 and to gradually pinch the tube 15 therebetween in an intersecting relation with the tube. When the pair of rolls 25 is disposed vertically (FIG. 6) the tube 15 is pinched completely from both sides. With progress in the intersection between the tube 15 and the presser rolls 25, (FIGS. 4, 5), the tube 15 is deformed gradually until it is completely flattened out (FIG. 6).

The other pair of presser rolls 25 displaced 180° from the aforesaid rolls 25 then is moved towards the lower forward portion of the tube 15 and starts to roll on and pinch the tube 15 in the same manner as mentioned above. The slurry contained in the tube 15 may thus be delivered continuously in the rotational direction of the presser rolls 25.

Figure 9A:
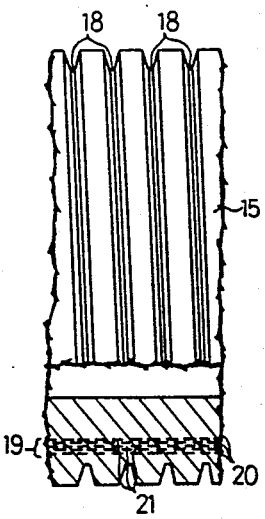
FIGS. 9(*a*), (*b*) are partial enlarged sectional views showing modified tubes.
Figure 9B:
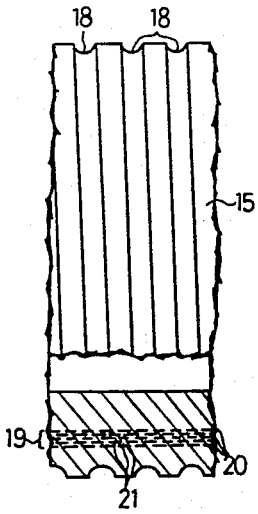

The peripheral grooves 18 on the outer surface of the tube 15 in the preceding embodiment may be replaced by a single spiral groove. The grooves 18 may be square-shaped in cross-section with the bottom portions of slightly reduced widths (FIG. 9*a*) or circular in cross-section (FIG. 9*b*).

Figure 10:
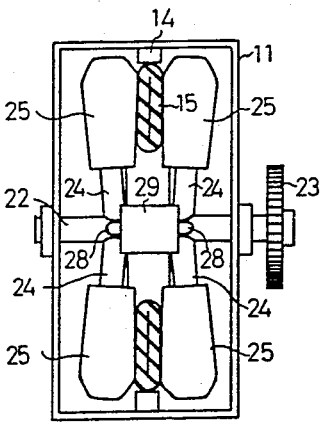
FIG. 10 is a side elevation of a squeeze pump having presser rolls with increased diameters towards radially outer end parts thereof.
Figure 11:
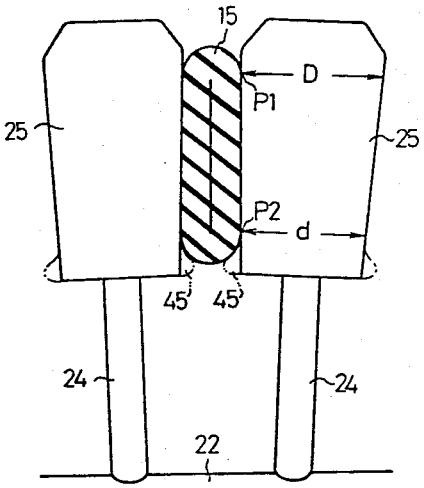
FIG. 11 is an enlarged view of the presser rolls of FIG. 10.

The presser roll 25 need not be columnar but may also be frusto-conical as shown in FIGS. 10 and 11. In the present embodiment, the presser rolls 25 are frusto-conical in cross-section with the diameters thereof increasing radially outwardly as shown in FIGS. 10 and 11, and the support shafts 24 are secured to the arbor 22 with a slight tilt towards outside. The rolls 25 have opposed sides parallel to each other so that the tube 15 may be clamped flat between these opposed sides. The diameter D of the roll 25 at a radially outer point P1 of the presser roll 25 clamping the radially outer portion of the tube 15 and the diameter d of the roll 25 at a radially inner point P2 of the roll 25 clamping the radially inner portion of the tube 15, wherein $D>d$, are determined to satisfy the relation $n2\pi(D/2)=2\pi R$ and hence $D=2R/n$, and $n2\pi(d/2)=2\pi r$ and hence $d=2r/n$, wherein R denotes the distance between the axes of the rotary arbor 22 and the point P1, r denotes the distance between the axes of the rotary arbor 22 and the point P2, wherein $R>r$, and n denotes rotational number that the presser roll 25 has rotated about its own axis without slipping during one complete revolution of the rotary arbor 22.

Accordingly, there is no slip of the radially outer point P1 of the roll 25 relative to the tube 15 due to the difference $2\pi(R-r)$ between the distance $2\pi R$ traversed by the point P1 and the distance $2\pi r$ traversed by the point P2 during one complete revolution of the roll 25 about the rotary arbor 22, so that the roll 25 in its entirety may pinch the tube 15 positively and consecutively.

On the other hand, should the diameter of each presser roll 25 be the same from the radially inner end to the radially outer end, a difference $2\pi(R-r)$ is caused between the distances $2\pi R$, $2\pi r$ traversed by the points P1 and P2 of each roll 25. This difference may be compensated as a slip of the radially outer end portion of the presser roll 25 relative to the tube 15.

In the embodiment shown in FIGS. 10, 11 to prevent the tube 15 from moving towards the rotary arbor 22 while the pair of rolls 25 rolls on the tube 15 to pinch the same, flange portions 45 may be provided to the radially inner portion of each presser roll 25 as indicated by double-dotted chain line in FIG. 11, or the opposing surfaces of the rolls 25 may be narrower at the radially inner portion so that the tube 15 tends to be extruded outwards away from said inner portion. Alternatively, the support shafts 24 may be secured at right angles to the arbor 22 and bent obliquely at intermediate portions for obliquely carrying the presser rolls 25.

It is to be noted that the present invention is not restricted to the above embodiments but may be executed in any of the following modes.

Figure 12:
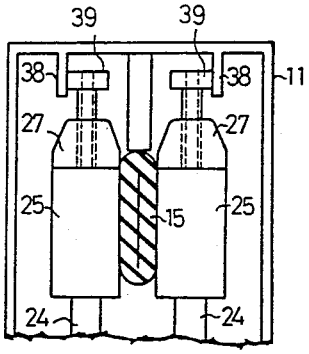
FIG. 12 is a partial enlarged side elevation showing support means for the end parts of the presser rolls.

(a) A pair of support rails 38 are projected integrally from the inner peripheral surface of the pump casing 11, as shown in FIG. 12 and a pair of support rolls 39 are provided to the end parts of the rolls 25 for rolling on and contacting with the inner sides of the support rails 38. In this arrangement, the rolls 25 may be immovably carried in the lateral direction at the foremost parts thereof so that the tube 15 may be pinched by the rolls 25 more reliably.

Figure 13A:
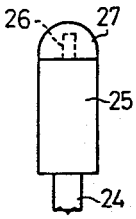
FIGS. 13(*a*) to (*c*) are front views showing modified pressure rolls.
Figure 13B:
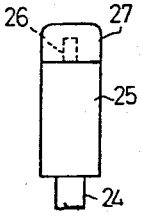
Figure 13C:
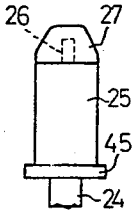
Figure 14:
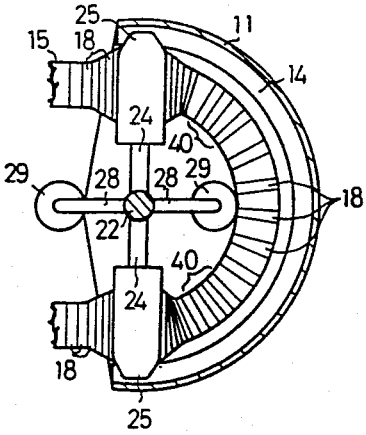
FIG. 14 is a front view showing a modified resilient tube.

(b) The foremost part of the resilient member 27 may be semispherical as shown in FIG. 13*a;* the protuberant end portion of the resilient member 27 may be rounded as shown in FIG. 13*b;* or a flange 45 may be provided to the radially inner end of the presser roll 25 for holding the inner periphery of the tube 15 as shown in FIG. 13*c*.

(c) The peripheral grooves 18 of the tube 15 disposed in upper and lower 45 degree zones (indicated at 40) rearwardly of the rotary shaft 22 may have smaller intervals from one another. In this arrangement, when the tube 15 is clamped by the presser rolls 25, the tube 15 is not liable to be flexed at said zones 40 and may be positively guided along the inner periphery of the pump casing 11.

I claim:

1. A squeeze pump comprising a semi-circular casing, a resilient tube situated along the inside of the semi-circular casing so that the direction of the tube is changed along the semi-circular portion of the casing, said tube including a plurality of grooves on the outer periphery so that the resilient tube is bent easily when pressure is applied thereto, material to be transferred passing through the resilient tube, a rotary arbor rotationally situated in the casing, said arbor being disposed equidistantly away from the curved portion of the resilient tube and adapted to be rotated by power means, at least one pair of means for pressing the resilient tube connected to the arbor, each pressing means including a support shaft extending outwardly from the arbor, and a presser roll rotationally connected to the support shaft and having a main body with a tapered head, said main body being frusto-conical with the diameter increasing towards the outer end thereof, the diameter D of the presser roll at the radially outer point thereof clamping the radially outer portion of the tube and the diameter d of the presser roll at the radially inner point clamping the radially inner portion of the tube being defined by $D=2R/n$, $d=2r/n$, wherein R, r denote the distances from the axis of the rotary arbor to said outer and inner points respectively, and n denotes the number of revolutions that the presser roll may rotate about its own axis without slipping when the rotary arbor performs one complete rotation, two pressing means facing each other so the innermost tangential planes on the main bodies facing each other are parallel and are spaced apart at a distance about twice as great as the thickness of the wall of the resilient tube, said pressing means, when the rotary arbor is rotated, at first nipping the tube by means of the tapered heads and then pressing the tube completely by means of the main bodies, and at least one auxiliary support shaft connected to the arbor, said auxiliary support shaft having a restoration roll rotationally connected thereto, said restoration roll being situated adjacent to the resilient tube so that after the tube is pressed by the presser rolls, the tube is urged by the restoration roll to return to its undistorted configuration.

2. A squeeze pump according to claim 1, in which said grooves are formed by a single spiral depression on the outer periphery of the resilient tube.

3. A squeeze pump according to claim 1, further comprising support rails situated at the inner periphery of the casing parallel to the resilient tube at both sides thereof, and support rolls rotationally connected to the outer ends of the respective presser rolls so that when the presser rolls press the tube, the support rolls engage the support rails to press the tube evenly by the presser rolls.

* * * * *